US005282910A

United States Patent [19]

Gabathuler et al.

[11] Patent Number: 5,282,910

[45] Date of Patent: Feb. 1, 1994

[54] PROCESS FOR HEATING A METAL ALLOY WORKPIECE

[75] Inventors: Jean-Pierre Gabathuler, Schleitheim; Yves Krähenbühl, Lausanne, both of Switzerland

[73] Assignee: Alusuisse-Lonza Services Ltd., Zurich, Switzerland

[21] Appl. No.: 889,126

[22] Filed: May 26, 1992

[30] Foreign Application Priority Data

Jun. 10, 1991 [CH] Switzerland ..... 1730/91

[51] Int. Cl.[5] ..... C22F 1/04

[52] U.S. Cl. ..... 148/567; 148/573; 148/688

[58] Field of Search ..... 148/567, 573, 688, 95

[56] References Cited

U.S. PATENT DOCUMENTS

| | | | |
|---|---|---|---|
| 3,948,650 | 4/1976 | Flemings et al. | 75/10.65 |
| 3,959,651 | 5/1976 | Welter | 250/310 |
| 4,577,081 | 3/1986 | Balzer | 164/462 |
| 5,009,844 | 4/1991 | Laxmanan | 148/95 |

FOREIGN PATENT DOCUMENTS

| | | |
|---|---|---|
| 0090253 | 10/1983 | European Pat. Off. . |
| 0093248 | 11/1983 | European Pat. Off. . |
| 0158946 | 10/1985 | European Pat. Off. . |
| 2266748 | 10/1975 | France . |
| 2112676 | 7/1983 | United Kingdom . |

OTHER PUBLICATIONS

Chemicals Engineers Handbook, 5th ed., McGraw Hill, 1973, p. 10–3.

*Primary Examiner*—George Wyszomierski
*Attorney, Agent, or Firm*—Bachman & LaPointe

[57] ABSTRACT

A metal alloy workpiece is heated convectively in a first step by heat conduction, heat radiation or further non-inductive heat transfer to a temperature lying just below the solidus temperature of the alloy and is heated inductively in a subsequent second step to the final temperature lying between solidus and liquidus temperature. The process is particularly suitable for producing workpieces having thixotropic properties intended for further processing, in particular for further processing bolts or bars in die-casting, forging, rolling and pressing plants.

8 Claims, No Drawings

PROCESS FOR HEATING A METAL ALLOY WORKPIECE

BACKGROUND OF THE INVENTION

The invention relates to a process for heating a solid metal alloy workpiece to a final temperature lying between solidus and liquidus temperature of the alloy, in particular for producing a part solid-part liquid, thixotropic state for the workpiece.

When producing metal alloy phases having thixotropic properties, it is known to set the temperature of an alloy melt to a value between solidus and liquidus temperature and to vigorously stir the alloy paste thus produced to convert the dendrites forming in the solidification process to form essentially globular cast grains. This process and the possibilities for using the metal alloy phase having thixotropic properties thus produced are described in detail, for example in U.S. Pat. No. 3,948,650 and U.S. Pat. No. 3,959,651.

These part solid-part liquid metal alloy phases are generally initially cooled below the solidus temperature of the alloy, generally to room temperature, and heated only shortly before further processing thereof to the required processing temperature, at which the thixotropic properties appear.

Coarsening of the cast grains is undesirable both in the production of the metal alloy phase having thixotropic properties and in the later repeated heating of the workpieces to the further processing temperature.

It is generally known to use oil, gas or resistanceheated furnaces with or without circulation of air, or even induction furnaces, to heat metal materials.

SUMMARY OF THE INVENTION

In view of these conditions, the inventors have set themselves the task of providing a process of the type discussed above, by means of which the thixotropic state of a metal alloy workpiece can be set at favorable cost for further processing thereof and without accepting an essential coarsening of grain.

The object is achieved in accordance with the invention in that the workpiece is heated in a first step by heat convection, heat radiation or further non-inductive heat transfer to a temperature lying just below the solidus temperature of the metal alloy and is heated inductively in a subsequent second step to the final temperature.

DETAILED DESCRIPTION

On the one hand, the required final temperature is reached rapidly by inductive heating in the second step, and consequently the residence time of the workpiece in the part solid-part liquid state, in which the strongest tendency to grain coarsening is observed, is kept as short as possible using the process of the invention. Since there is a temperature increase on the workpiece of only about 30° to 100° C. in this second step, the wattage and hence the size of the induction heating plant may also be relatively small and hence be designed at favorable cost. On the other hand, the loss of energy when heating by non-inductive heat transfer in the first step, taking into account the large temperature difference, is considerably smaller than for corresponding induction heating.

Under practical conditions, the temperature reached after the first heating step is about 10° to 50° C. below the solidus temperature of the metal alloy. The solidus temperature should never be exceeded.

The workpiece is preferably inductively heated in the second step at an alternating current frequency between 50 and 1,000 Hz and a heating rate between about 10 and 200 kW. Alternating current frequency and heating rate are matched to one another, such that the surface temperature of the workpiece never exceeds the required final temperature while maintaining as short a time as possible to reach the final temperature.

The process of the invention is advantageously carried out continuously under production conditions. Heating in the first step is preferably carried out here in a continuous or tunnel furnace, and in the second step in cycles by respective transfer to sequential induction coils, wherein the throughput rate of the workpieces through the continuous or tunnel furnace, the cycle time of the induction heating plant and the cycle time of the subsequent further processing plant are matched to one another. Several lines of induction coils may also be used per continuous or tunnel furnace.

A further advantage of the solution of the invention can be seen in that, if there is an interruption at the further processing plant, there is less rejection of workpieces in the part solid-part liquid state than in a cyclic process using inductive heating even in the first step, since fewer induction coils are required using the process of the invention at the same production rate.

The process of the invention is preferably used in the production of workpieces having thixotropic properties intended for further processing, in particular for further processing bolts or bars in die-casting, forging, rolling and pressing plants.

The process is particularly suitable for heating Aluminum alloy workpieces.

The process of the invention is illustrated in more detail below using an exemplary embodiment.

EXAMPLE

An alloy of the type AlSi7Mg with 6.9 wt.% of Si and 0.4 wt.% of Mg was cast in a continuous casting plant while producing a thixotropic structure to form a strand 75 mm in diameter and cut to from bolts 180 mm high. The average diameter of the globular cast grains was less than 100 μm. The solidus temperature of the alloy is 555° C. The bolts were heated for two hours at the set furnace temperature of 540° C. in a holding furnace with air circulation. The bolts were then heated in an induction coil having a wattage of 25 kW and an alternating current frequency of 250 Hz to the final temperature of about 580° C. within 6 minutes, corresponding to a liquid metal portion of 30 to 40%. The metallographic investigation on bolt cross-sections showed that no substantial grain coarsening had occurred, that is to say the average grain size was still below 100 μm.

We claim:

1. Process for heating a solid metal alloy workpiece to a final temperature lying between the solidus and liquidus temperature of the alloy for producing a part solid-part liquid, thixotropic state for the workpiece, which comprises: heating a workpiece in a first step by a method selected from the group consisting of heat convection, heat conduction, heat radiation and further non-inductive heat transfer, to a temperature lying 10° to 50° C. below the solidus temperature of the alloy; and subsequently heating said workpiece inductively in a second step to a final temperature, thereby producing a part solid-part liquid, thixotropic state for the workpiece without substantial grain coarsening.

2. Process according to claim 1 wherein the workpiece is heated in the second step at an alternating current frequency between 50 and 1000 Hz.

3. Process according to claim 2 wherein the workpiece is heated in the second step at a rate between 10 and 200 kW.

4. Process according to claim 1 wherein workpieces are heated continuously in the first step in a continuous or tunnel furnace.

5. Process according to claim 4 wherein several induction coil lines are used per continuous or tunnel furnace.

6. Process according to claim 1 wherein workpieces are heated in cycles in the second step in several sequential induction coils.

7. Process according to claim 1 wherein said workpiece is an aluminum alloy.

8. Process according to claim 1 wherein the average grain size after the second step is below 100 microns.

* * * * *